United States Patent [19]

Kitano et al.

[11] 4,350,124

[45] Sep. 21, 1982

[54] OVERFLOW DEVICE FOR VEHICULAR CARBURETOR

[75] Inventors: Akihiro Kitano; Kunio Kamekawa, both of Hamamatsu, Japan

[73] Assignee: Yamaha Hatsudoki Kabushiki Kaisha, Iwata, Japan

[21] Appl. No.: 184,644

[22] Filed: Sep. 5, 1980

[30] Foreign Application Priority Data

Sep. 29, 1979 [JP] Japan ..... 54-125638

[51] Int. Cl.[3] ..... F02M 19/06

[52] U.S. Cl. ..... 123/198 R; 123/557; 123/198 D; 261/72 R; 261/DIG. 21; 261/DIG. 50; 261/DIG. 67

[58] Field of Search ..... 123/198 D, 198 DB, 557, 123/514, 518, 198 R; 261/72 R, DIG. 50, DIG. 21, DIG. 67

[56] References Cited

U.S. PATENT DOCUMENTS

| | | | |
|---|---|---|---|
| 1,912,842 | 6/1933 | Hobbs | 261/DIG. 67 |
| 2,695,029 | 11/1954 | Bruegger | 261/72 R |
| 3,162,235 | 12/1964 | Capehart | 261/36 A |
| 3,695,590 | 10/1972 | Nishihara | 261/72 R |
| 3,825,238 | 7/1974 | Nishihara et al. | 261/DIG. 67 |
| 3,964,503 | 6/1976 | Kikuchi | 123/198 DB |
| 3,983,890 | 10/1976 | Rogers, Jr. | 123/198 DB |
| 4,011,848 | 3/1977 | Coddington | 123/198 DB |
| 4,168,289 | 9/1979 | Saunion | 261/DIG. 50 |

*Primary Examiner*—Ira S. Lazarus

*Attorney, Agent, or Firm*—Donald D. Mon

[57] ABSTRACT

An overflow device for a vehicular carburetor. The carburetor includes a float chamber in which a maximum level is to be maintained. A drainage tube drains fuel at higher levels to a reservoir at an elevation lower than the carburetor. A vent tube vents the reservoir at an elevation higher than the carburetor. The reservoir can be heated by engine heat to evaporate excess fuel.

6 Claims, 5 Drawing Figures

OVERFLOW DEVICE FOR VEHICULAR CARBURETOR

FIELD OF THE INVENTION

This invention relates to an overflow device for the carburetor of a vehicle such as a motorcycle or tricycle vehicle.

BACKGROUND OF THE INVENTION

A motorcycle or tricycle vehicle equipped with balloon tires is frequently used to run offroad, i.e., on an undulating field so that the fluid level in the float chamber of the carburetor moves up and down. In order to control the fluid level in the float chamber, there has been adopted means in which the float chamber is formed with an overflow port connected with a pipe for discharging the fuel which has overflowed.

While running off the road, however, the vehicle may run in a deep pond or pool. In this instance, since the motorcycle or tricycle structurally has its engine disposed at a relatively low position, the carburetor is also disposed at an accordingly low level. Consequently, if the aforementioned overflow pipe is in a depending position, its open end may dip into the water. This may invite backflow of water into the float chamber so that water is mixed into the fuel, thereby to cause the engine to be troubled or stopped.

The present invention has been conceived in view of the background thus far described and contemplates to provide an overflow device for a vehicular carburetor, by which the backflow of water is blocked to prevent the engine from being troubled or stopped without adversely affecting the overflow function.

BRIEF DESCRIPTION OF THE INVENTION

This invention is carried out in combination with a carburetor which has an overflow port from its float chamber. A fuel reservoir is mounted to the vehicle at an elevation below that of the carburetor, and has an air vent which vents to the atmosphere at an elevation above that of the carburetor.

The invention will be described in connection with one embodiment thereof, with reference to the accompanying drawings, in which:

DETAILED DESCRIPTION OF THE INVENTION

Figure 1:
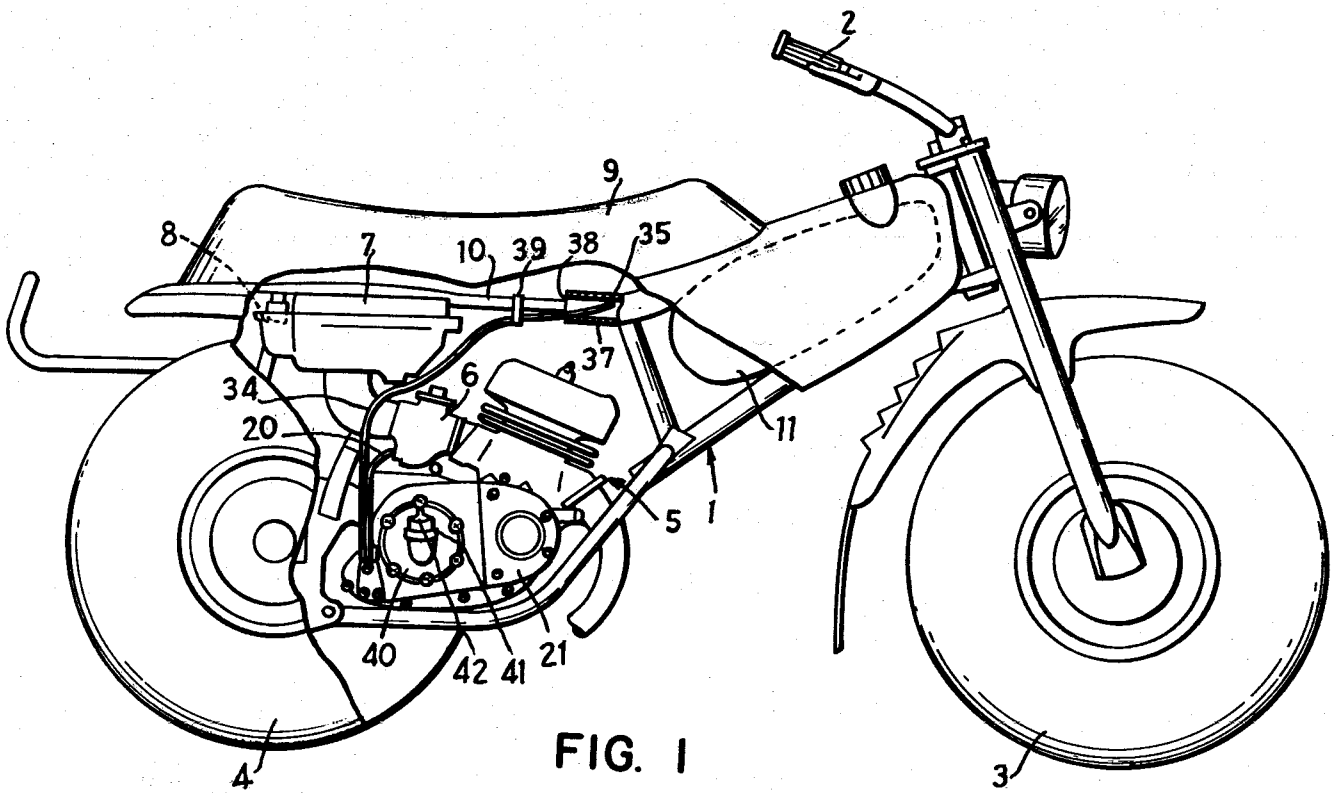
FIG. 1 is a side elevation showing one embodiment of the invention.
Figure 2:
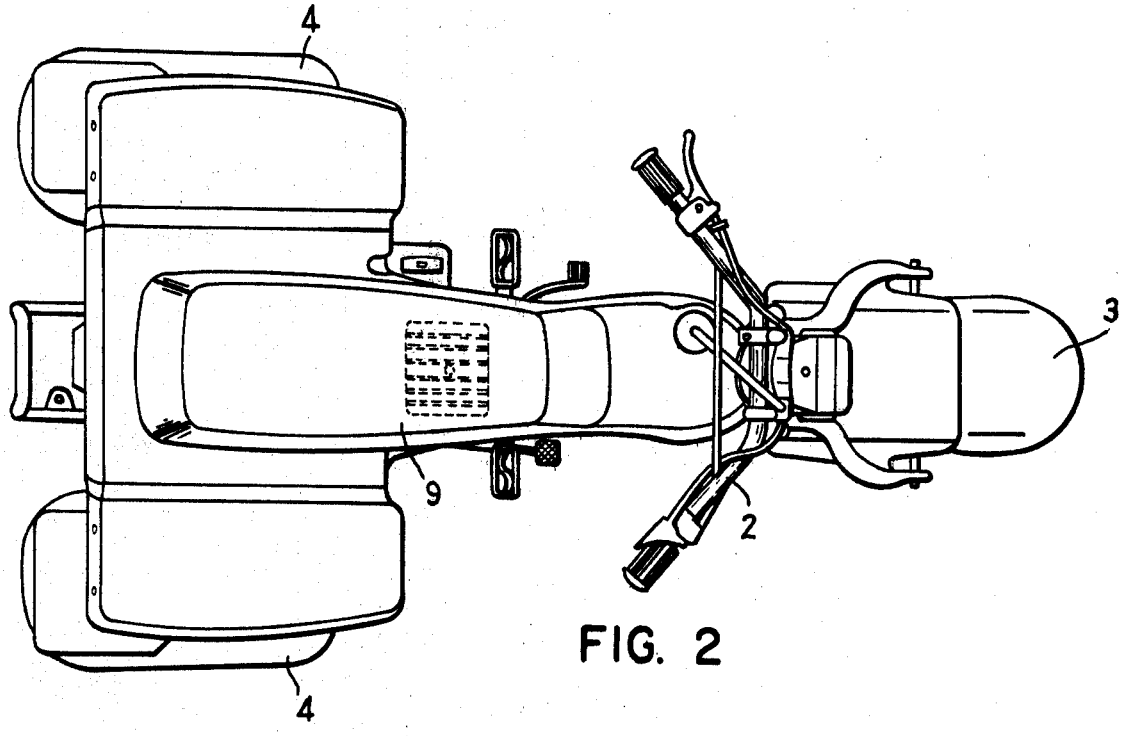
FIG. 2 is a top plan view of FIG. 1.

The accompanying drawings show a tricycle vehicle for offroad runs. A body 1 which is made of a pipe frame. To the front end of frame 1 there is attached a steering handle 2, to the lower end of which is attached a front or steering wheel 3 equipped with a balloon tire. To the rear end of frame 1 there are attached two rear or drive wheels 4, also equipped with balloon tires.

An engine, e.g., a two-cycle air-cooled engine 5 is carried on frame 1 at a relatively rearward position. Engine 5 is connected with a carburetor 6 and an air cleaner 7. Air cleaner 7 is equipped at the other side of the sheet of FIG. 1 with an air inlet 8 which is opened forwardly relative to the direction of forward motion of the vehicular body. Above engine 5, carburetor 6 and air cleaner 7, there is disposed a seat 9 which is fixed to a seat rail 10. Carburetor 6 is connected with a fuel tank 11 which is disposed at a front position of frame 1.

Figure 3:
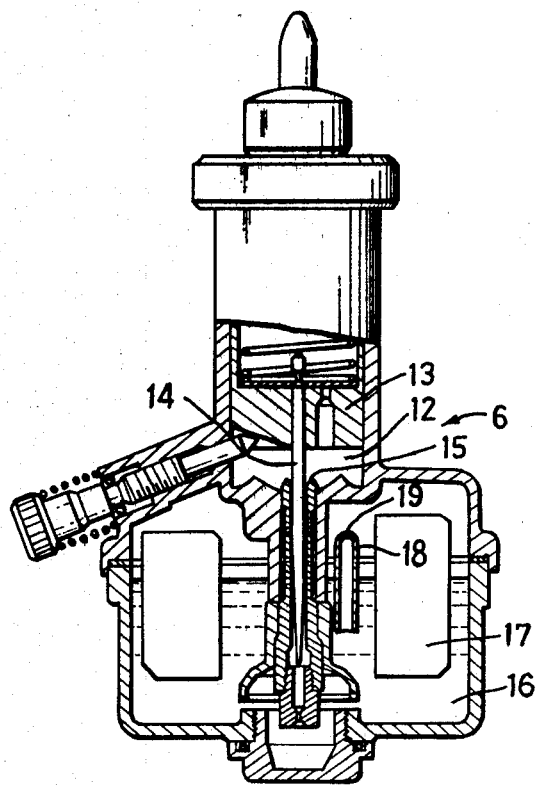
FIG. 3 is a sectional view of a carburetor.

Carburetor 6, thus connected, is so constructed as is more specifically shown in FIG. 3. That is, an intake passage 12 has its effective area controlled by a piston valve 13. Piston valve 13 is equipped with a needle valve 14 for opening and closing a needle jet 15. Needle jet 15 is made to communicate with a float chamber 16, in which is mounted a float 17 and in which is mounted an overflow pipe 18 rising to protrude from a preset fluid level. Overflow pipe 18 has its upper end formed with an overflow port 19 which is made to communicate through the aforementioned pipe 18 with a tube (or pipe) 20 shown in FIG. 1.

Below, there is disposed the crankcase 21 of engine 5, which is constructed as specifically shown in FIGS. 4 and 5. That is to say, crankcase 21 has an opening at one side of its body 22 closed with a case cover 23. Case cover 23 is integrally formed with a fuel reservoir 24. Fuel reservoir 24 is constructed of a cover wall 25 of the aforementioned case cover 23, a peripheral wall 26 integrally extending out of the cover wall 25, and a stop cover 27 closing the open end of peripheral wall 26. Peripheral wall 26 is formed with a recess 28 therein, which is made to communicate with the inside of the crankcase 21 so that it is entered by the engine oil 29 which is stored in the crankcase 21. The stop cover 27 is made of a material such as a synthetic resin and is sealingly attached to the open end of the peripheral wall 26 through a packing 30 and screws 31. Moreover, stop cover 27 is integrally formed with an inlet port 32, which has communication with fuel reservoir 24, and an outlet port 33 through which the fuel gasified in the fuel reservoir 24 flows out. With the aforementioned inlet port 32, there is connected the aforementioned overflow tube 20 which in turn is connected with the overflow pipe 18. On the other hand, another discharge tube 34 is connected with the aforementioned outlet port 33. Discharge tube 34 is formed at its leading end with an air vent 35 (FIG. 1), which is inserted into the opening 38 of a main pipe 37 disposed above the carburetor 6. A fixture 39 is provided for fixing discharge tube 34 to seat rail 10.

Figure 4:
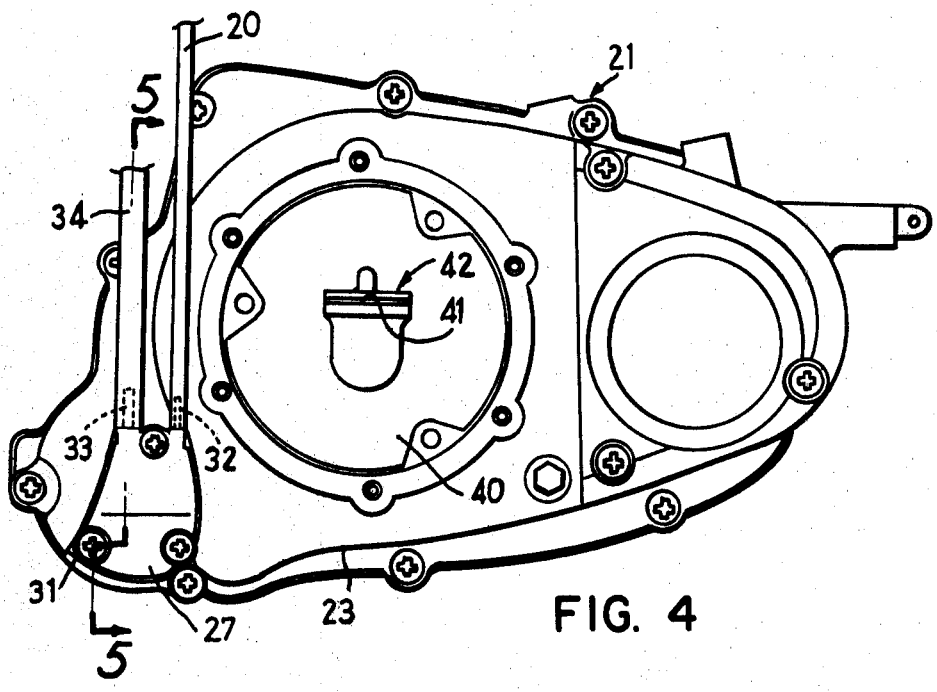
FIG. 4 is a side elevation showing a crankcase.
Figure 5:
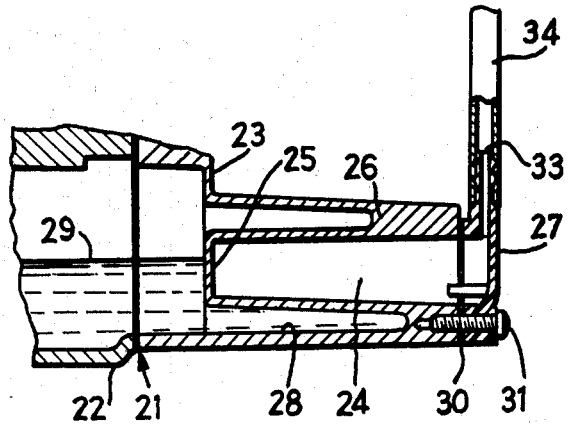
FIG. 5 is a cross-section taken at line V—V in FIG. 4.

To case cover 23 of crankcase 21 there is fastened, as shown in FIG. 4, a clutch cover 40 which is formed with an engine oil inlet 41 closed by a cap 42. As a result, engine oil 29 in crankcase 21 can be supplied through oil inlet 41.

In the case of an offroad run, i.e., a run on an undulating road or field, the tricycle vehicle thus constructed is intensely vibrated, and the fuel level in float chamber 16 of the carburetor 6 accordingly moves up and down. If the fuel level becomes higher than the overflow port 19, excess fuel flows out of overflow port 19 into overflow tube 20 through overflow pipe 18. As a result, it is possible to control the fuel level in that float chamber 16 without blocking overflow in the float chamber 16.

On the other hand, the fuel thus stored in the fuel reservoir 24 partly evaporates in a spontaneous manner and is partly forced to evaporate by the heat of the crankcase. More specifically, the engine oil 29 in crankcase 21 is stored at a high temperature because it has already partly lubricated and partly cooled the respective parts of the engine. The heat of engine oil 29 is conducted through cover wall 25 and peripheral wall 26 of case cover 23 to the fuel reservoir 24 so that fuel in fuel reservoir 24 is evaporated. Thus, the fuel having overflowed into fuel reservoir 24 is instantly gasified so that the capacity of the fuel reservoir 24 can be minimized.

The fuel thus gasified is guided by discharge tube 34 until it is discharged to the atmosphere from air vent 35 through opening 38 of main pipe 37.

With the construction thus far described, therefore, even if the vehicle runs in a deep pond or pool, no entry of water takes place through air vent 35 of discharge tube 34 because air vent 35 is opened at a relatively high elevation on frame 1. As a result, there is no fear of any water entering into float chamber 16 of carburetor 6, and the engine 5 will not be stopped or troubled by entry of water. Moreover, since discharge tube 34, extending upward, is inserted into main pipe 37, it is free from entry of rain droplets.

As is apparent from the foregoing description, the present invention should not have its application limited to the tricycle but can also be practiced in a motorcycle.

Moreover, fuel reservoir 24 should not necessarily be limited to the construction shown, in which it is mounted in the crankcase 21. It is sufficient merely that reservoir 24 be positioned at an elevation below that of carburetor 6.

According to the present invention, the overflow port formed in the carburetor is made to communicate with the fuel reservoir which is disposed below the carburetor, and the fuel reservoir itself is connected with an air vent which is disposed above the aforementioned carburetor. According to this construction arrangement, therefore, the fuel having overflowed from the carburetor flows down into the fuel reservoir and then evaporates to the atmosphere through the air vent, thereby to ensure the overflow so that the fuel level in the carburetor can be very accurately controlled. Since, moreover, the air vent is positioned above the carburetor, even if any parts of the vehicular body dip into the water in the case of runs in a pond or pool, that air vent is never submerged in the water so that no water can flow back into the carburetor. Consequently, there is no fear of any water being mixed into the fuel to stop or to perturb the engine.

This invention is not to be limited by the embodiment shown in the drawings and described in the description, which is given by way of example and not of limitation, but only in accordance with the scope of the appended claims.

We claim:

1. An overflow device for a vehicular carburetor which is carried on the body of a vehicle and includes a float chamber whose overfilling is prevented by drainage through said overflow device, said overflow device comprising: a reservoir disposed at an elevation beneath said float chamber, an overflow tube opening into said float chamber at an intended maximum fuel level therein and discharging into said reservoir, and a vent tube rising from an upper level in said reservoir to a vent opening at an elevation above said carburetor.

2. Apparatus according to claim 1 in which said reservoir is disposed in a location to be heated by engine heat for the purpose of evaporating fuel therein.

3. Apparatus according to claim 2 in which said reservoir is integral with the crankcase of said engine, and heated by engine oil.

4. Apparatus according to claim 1 in which said vent opening is disposed in a shrouded portion of said body to resist entrance of water therein.

5. Apparatus according to claim 2 in which said vent opening is disposed in a shrouded portion of said body to resist entrance of water therein.

6. Apparatus according to claim 5 in which said reservoir is integral with the crankcase of said engine, and heated by engine oil.

* * * * *